US005103866A

United States Patent [19]

Foster

[11] Patent Number: 5,103,866

[45] Date of Patent: Apr. 14, 1992

[54] POPPET VALVE AND VALVE ASSEMBLIES UTILIZING SAME

[76] Inventor: Raymond K. Foster, P.O. Box 1, Madras, Oreg. 97741

[21] Appl. No.: 659,843

[22] Filed: Feb. 22, 1991

[51] Int. Cl.[5] ..... F15B 13/042

[52] U.S. Cl. ..... 137/596.15; 137/596.18; 137/625.27; 137/625.66; 251/210

[58] Field of Search ..... 137/625.27, 625.63, 137/625.66, 596.15, 596.18; 251/210

[56] References Cited

U.S. PATENT DOCUMENTS

| | | | |
|---|---|---|---|
| 172,492 | 1/1876 | Prall | 137/625.66 |
| 1,125,825 | 1/1915 | Englesson | 137/625.63 |
| 2,658,523 | 11/1953 | Johnson | 137/625.27 X |
| 2,913,005 | 11/1959 | Grant et al. | 137/625.6 |
| 3,244,193 | 4/1966 | Loveless | 137/625.27 X |
| 3,415,284 | 12/1968 | Stampfli | 137/625.66 |
| 3,500,865 | 3/1970 | Gerber et al. | 137/625.6 |
| 3,706,325 | 12/1972 | Pauliukonis | 137/625.27 X |
| 3,762,443 | 10/1973 | Sorenson | 137/625.27 |
| 4,023,466 | 5/1977 | Strassheimer | 251/210 X |
| 4,161,136 | 7/1979 | Krieger | 137/596.14 X |
| 4,630,645 | 12/1986 | Spa | 137/625.66 X |

*Primary Examiner*—Gerald A. Michalsky
*Attorney, Agent, or Firm*—Delbert J. Barnard

[57] ABSTRACT

In a housing, there is formed, in series, a first end cavity, a first cylinder cavity, a pressure cavity, a second cylinder cavity and a second end cavity. The cavities are separated by walls which include orifices. Two identical valve members are located in the housing. The first valve member has a piston and a valve plug in the first end cavity and a valve plug in the pressure cavity. The second valve member has a piston and a valve plug in the second end cavity and a valve plug in the pressure cavity. Pressure in the pressure cavity acts on the confronting ends of the two valve members. A two position control rod, in a first position, connects pressure to the piston in the first end chamber and connects the second end chamber to return. The piston has a larger area than the second end of the valve member, creating a force differential which moves the first valve member endwise inwardly. Pressure acting on the second end of the second valve member moves it endwise outwardly. The same control rod, in its second position, connects the second piston with pressure and the first piston with return. Pressure acting on the second end of the first valve member moves it endwise outwardly. Pressure acting on the second piston moves the second valve member endwise inwardly. Such movement of the valve members moves the valve plugs to open and close orifices in the separator walls, to switch pressure and return between two paths leading from the valve assembly.

9 Claims, 10 Drawing Sheets

Fig.15
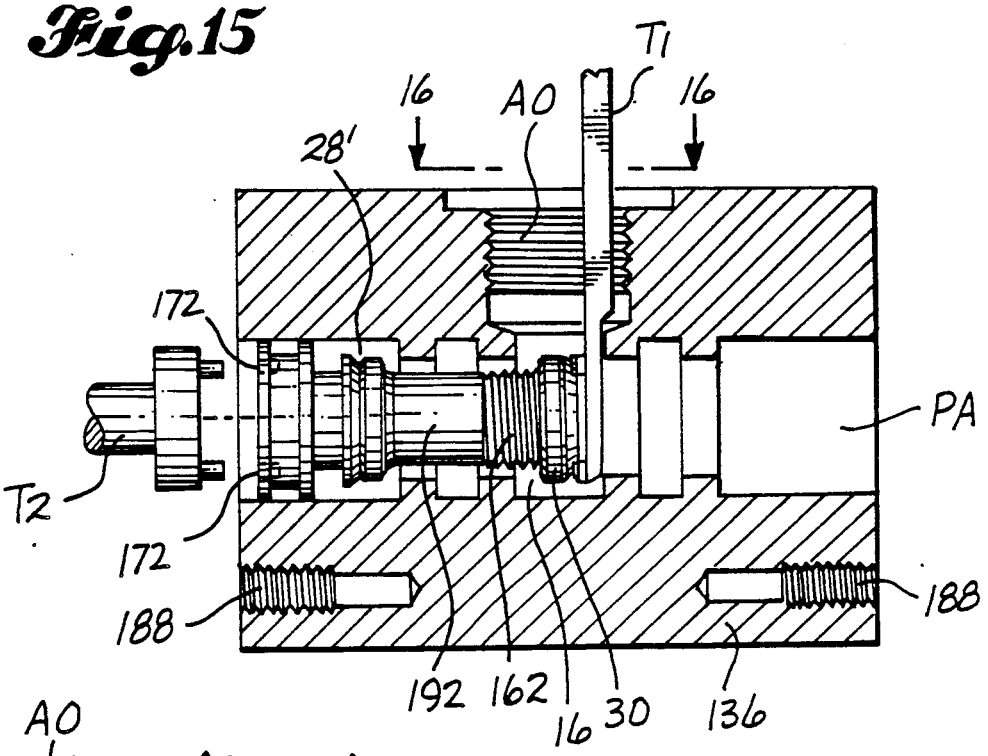
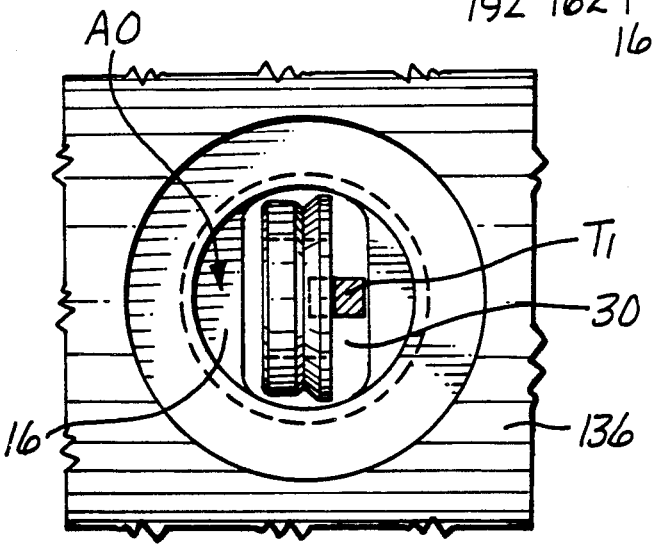
Fig.16

POPPET VALVE AND VALVE ASSEMBLIES UTILIZING SAME

DESCRIPTION

1. Technical Field

This present invention relates to valves for use in hydraulic power systems for controlling reversible piston-cylinder units. More particularly, it relates to the provision of an improved poppet valve and to improved switching or directional valves which utilize the improved poppet valve.

2. Background Information

There exist many installations in which reversible piston-cylinder units are used for moving machine parts back and forth along a path of travel. A standard cylinder includes an elongated tubular housing. The piston includes a piston head within the housing and a piston rod which extends outwardly from end of the housing. In some installations the piston is fixed and the housing is movable. In other installations the housing is fixed and the piston is movable. In either case, first and second variable volume chambers are formed in the housing on opposite sides of the piston head. In operation, hydraulic pressure is first introduced into one of the chambers while the second chamber is connected to a return line, to cause movement in a first direction. Then, hydraulic pressure is applied to the second chamber and the first chamber is connected to the return line, for causing movement of the movable component in the opposite direction. The switching of pressure and return between the two chambers is accomplished by use of a switching valve, also termed a directional valve.

The most common switching valve includes a housing having an inlet port which receives hydraulic pressure from a pressure line, a return port which is connected to a return line, a first chamber port which connects to a line that extends to and from the first chamber of the piston-cylinder unit, a second chamber port which connects to a line which extends to and from the second chamber of the piston-cylinder unit, and a valve spool in the housing which is movable endwise between first and second positions. In one position of the valve spool, the inlet port is connected with the first chamber port and the second chamber port is connected with the return port. In a second position of the valve spool. The inlet port is connected to the second chamber port and the first chamber port is connected to the return port. The valve spool is moved back and forth between the two positions in a number of ways. In some installations a spring is used to bias the valve spool into a first position and an applied force is used to move the valve spool into the second position, in opposition to the spring force. In other installations, an applied force is used to move the spool valve in both directions. The applied force may be a fluid pressure force, an electric solenoid force, a mechanical push force, or a manual push force. One type of force may be used to move the spool in one direction and another such force be used to move the spool in the opposite direction.

The pressure drop across a spool valve is relatively high and the operating efficiency of the system is low. Also, there tends to be leakage from the pressure port to the return port. Spool valves can only stand a small amount of wear. They are easily damaged by particulate material in the hydraulic fluid. Also, the shifting of the spool creates a hydrodynamic shock in the system which shortens the life of seals used in the system. A principal object of the present invention is to provide an improved switching valve which is composed of poppet valves in place of a spool valve. A further object is to provide an improved poppet valve.

DISCLOSURE OF THE INVENTION

Valves constructed in accordance with the present invention include a first cavity, a second cavity and a first divider wall between the first cavity and the second cavity. The divider wall includes a first valve orifice. A second divider wall is positioned between the second cavity and a third cavity. The second divider wall includes a second valve orifice. The first divider wall includes a first valve seat directed towards the first cavity. The second divider wall includes a second valve seat directed towards the third cavity. A poppet is provided of a type including a first valve plug positioned in the first cavity, a second valve plug positioned in the third cavity, and a connector portion interconnecting the first valve plug and the second valve plug. The first valve plug includes a closure surface directed towards the first valve seat. The second valve plug includes a closure surface directed towards the second valve seat. The first and second valve plugs are spaced axially apart a sufficient distance that when the closure surface of one of the valve plugs engages its valve seat, to close its valve orifice, the other valve plug is spaced from its valve seat, to open the other valve orifice.

A switching valve constructed according to the present invention is basically characterized by a first cavity having an end wall, a cylinder cavity, and a first divider wall positioned between said first cavity and said cylinder cavity. The first divider wall includes a first valve orifice. A second divider wall is positioned between the first cylinder cavity and a pressure cavity. The second divider wall includes a second valve orifice. The first divider wall includes a first valve seat directed towards the first cavity. The second divider wall includes a second valve seat directed towards the pressure cavity. A poppet is provided which includes a piston and a first valve plug located in said first cavity. A second valve plug is located in the pressure cavity. A first connector portion interconnects the piston and the first valve plug. A second connector portion interconnects the first valve plug in the second valve plug. The piston includes an end surface directed towards the end wall. The first valve plug includes a closure surface directed towards the first valve seat. The second valve plug includes a closure surface directed towards the second valve seat. The second valve plug also includes an end surface in said pressure cavity directed away from the second valve seat. The end surface on the piston is larger in area than the end surface on the second valve plug. A pressure delivery passageway communicates with the pressure cavity. A return passageway communicates with the end cavity, adjacent the first divider wall. A cylinder passageway communicates with the cylinder cavity. A pilot passageway communicates with the end cavity, between the end wall of the cavity and the end surface of the piston. The pilot passageway is either connected to pressure or to return. When it is connected to pressure, the pressure acting on the end surface of the piston is larger than the pressure acting on the end surface of the second valve plug. A pressure differential exists which moves the poppet, to seat the first valve plug on the first valve seat, and to move the second valve plug away from the second valve seat. This closes the first valve orifice and opens the second valve orifice, connecting the pressure cavity to the cylinder passageway. When the pilot passageway is connected to return, the pressure acting on the end of the second valve plug moves the poppet endwise, seating the second valve plug against the second valve seat and moving the first valve plug away from the first valve seat. The second valve orifice is closed, the first valve orifice is opened, and the cylinder passageway is connected with return via the open first valve orifice.

In accordance with an important aspect of the invention, the first valve plug includes a cylindrical portion sized to snugly fit within the first valve orifice. In like fashion, the second valve plug includes a cylindrical portion sized to snugly fit within the second valve orifice. During movement of the poppet between a first position wherein the closure surface of the first valve plug is seated against the first seat and a second position in which the closure surface of the second valve plug is seated against the second valve seat, the cylindrical portion of at least one valve plug is in a flow blocking relationship with its valve orifice, to prevent a short circuiting of pressure from the pressure cavity to the return passageway.

According to another aspect of the invention, the switching valve includes a control rod that is movable endwise between two end positions. The control rod includes a passageway positioned to, when the control rod is in its first position, connect the pilot passageway to pressure, and when the control rod is in its second position, connect the pilot passageway to return.

In preferred form, the switching valve includes a first end cavity having a first end wall, a first cylinder cavity and a first divider wall between the first end cavity and the first cylinder cavity. The first divider wall includes a first valve orifice. A second divider wall is positioned between the first cylinder cavity and a pressure cavity. The second divider wall includes a second valve orifice. A third divider wall is positioned between the pressure cavity and the second cylinder cavity and the second end cavity. A fourth divider wall is positioned between the second cylinder cavity and the second end cavity. The third divider wall includes a fourth valve orifice. The fourth divider wall includes a third valve orifice. The first divider wall includes a first valve seat directed towards the first end cavity. The second divider wall includes a second valve seat directed towards the pressure cavity. The third divider wall includes a third valve seat directed towards the pressure cavity. The fourth divider wall includes a fourth valve seat directed towards the second end cavity. The valve includes a first poppet having a first piston and a first valve plug located in the first end cavity, a second valve plug located in the pressure cavity, a first connector portion interconnecting the first piston and the first valve plug, and a second connector portion interconnecting the first valve plug and the second valve plug. The first piston includes an end surface directed towards the first end wall. The first valve plug includes a closure surface directed towards the first valve seat. The second valve plug includes a closure surface directed towards the second valve seat. The second valve plug includes an end surface in the pressure cavity directed away from the second valve seat. The end surface on the first piston is larger in area than the end surface on the second valve plug. The valve also includes a second poppet having a second piston and a third valve plug located in the second end cavity, a fourth valve plug located in the pressure cavity, a third connector portion interconnecting the second piston and the third valve plug, and a fourth connector portion interconnecting said third valve plug and said fourth valve plug. The second piston includes an end surface directed towards said second end wall. The fourth valve plug includes a closure surface directed towards the fourth valve seat. The fourth valve seat includes a closure surface directed towards the third valve seat. The fourth valve plug includes an end surface in the pressure cavity directed away from the fourth valve seat. The end surface on the second piston is larger in area than the end surface on the fourth valve plug. A pressure delivery passageway communicates with the pressure cavity. A first return passageway communicates with the first end cavity, adjacent the first divider wall. A second return passageway communicates with the second end cavity, adjacent the fourth divider wall. A first cylinder passageway communicates with the first cylinder cavity. A second cylinder passageway communicates with the second cylinder cavity. A first pilot passageway communicates with the first end cavity, between the first end wall and the end surface of the first piston. A second pilot passageway communicates with the second end cavity, between the second end surface and the end surface of the second piston. In use, the first pilot passageway is connected to pressure and the second pilot passageway is connected to return, or the first pilot passageway is connected to return and the second pilot passageway is connected to pressure. In the first condition, the first valve plug is seated on the first valve seat, closing the first valve orifice and spacing the second valve plug away from the second valve seat, to open the second valve orifice. This connects the pressure cavity to the first cylinder passageway. At the same time, the third valve plug is seated on the fourth valve seat, closing the third valve orifice And, the third valve plug is spaced from the fourth valve seat, opening the fourth valve orifice. The second cylinder passageway is connected with return via the opened third valve orifice. When the pressure is connected to the second pilot passageway, and the first pilot passageway is connected to return, the first valve orifice is open, the second valve orifice is closed by the second valve plug, the fourth valve orifice is closed by the third valve plug, and the third valve orifice is open. As a result, the pressure cavity is connected to the second cylinder passageway and the first cylinder passageway is connected to return.

Other objects, features and advantages of the invention are hereinafter described as a part of the description of the best mode.

BRIEF DESCRIPTION OF THE DRAWINGS

Like reference numerals are used to designate like parts throughout the several views of the drawing, and:

FIG. 15 is a fragmentary sectional view of the switching valve housing showing the two poppet member parts in the process of being threaded together;

FIG. 16 is a plan view taken substantially along line 16—16 of FIG. 15; and

BEST MODE FOR CARRYING OUT THE INVENTION

Figure 1:
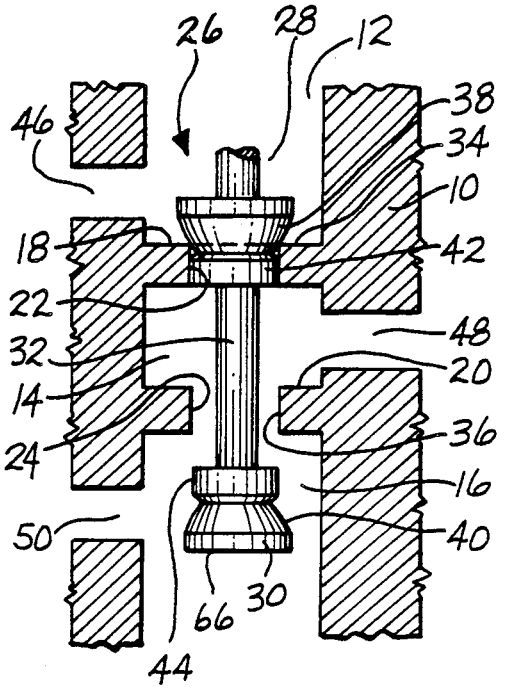
FIG. 1 is a diagrammatic view of a double plug poppet valve constructed in accordance with the present invention, showing the valve housing in section and the poppet member in elevation.

Referring to FIG. 1, a valve housing 10, is shown to define a first cavity 12, a second cavity 14, and a third cavity 16. A first divider wall 18 is positioned between cavity 12 and cavity 14. A second divider wall 20 is positioned between cavity 14 and cavity 16. Divider wall 18 includes a valve orifice 22 which includes a cylindrical portion where it extends through wall 18. Divider wall 20 includes a valve orifice 24 which includes a cylindrical portion where it extends through wall 20. A double plug poppet 26 is positioned within housing 10. Poppet 26 reciprocates between two end positions, one of which is shown in FIG. 1. Poppet 26 includes a valve plug 28, a valve plug 30 and an interconnecting portion 32.

Divider wall 18 provides a valve seat 34 at the end of orifice 22 which is directed towards cavity 12. In similar fashion, divider wall 20 provides a valve seat 36 at the end of orifice 24 which is directed towards cavity 16. Valve plug 28 includes a generally conical valve surface 38 that is directed towards valve seat 34. Valve plug 30 includes a generally conical valve surface 40 which is directed towards valve seat 36.

Preferably, valve plug 38 includes a cylindrical portion 42 positioned between it and connector 32. In like fashion, valve plug 40 includes a cylindrical portion 44 positioned between it and the connector 32. The axial distance between the confronting ends of cylindrical portions 42, 22 is substantially equal to the axial distance between the two valve seats 34, 36, for reasons to be described below.

Cavity 12 is shown to include a fluid port 46. Cavity 14 includes a fluid port 48. Cavity 16 includes a fluid port 50. In FIG. 1, cylindrical portion 42 of plug 28 is shown to be within the cylindrical portion of orifice 22 and the valve surface 38 is shown to be in contact With the valve seat 34. In this position, the communication between cavity 12 and cavity 14 via orifice 22 is closed. Valve plug 30 and its cylindrical portion 44 are spaced endwise of orifice 24. Thus, cavity 14 is in communication with cavity 16. If the poppet 28 is moved endwise to move valve plug 30 towards valve seat 36 and valve plug 28 away from valve plug 34, the cylindrical portion of valve plug 44 will enter into the cylindrical portion of orifice 24 about the same time that the cylindrical portion 42 of valve plug 28 moves out from orifice 22. Further movement of the poppet 26, in the same direction, will move valve surface 40 of valve plug 30 into contact with valve seat 36. At the same time, valve surface 38 will be moved away from valve seat 34 and cylindrical portion 42 of valve plug 26 will be moved out from orifice 22 and endwise from the valve seat 34 a distance substantially equal to the illustrated spacing between the end of cylindrical portion 44 and valve seat 36. This is the second position of the valve plug 26. When valve plug 26 is in this second position, the engagement between valve surface 38 and valve seat 34 closes communication between cavity 12 and cavity 14 and opens communication between cavity 14 and cavity 16.

The fit of the cylindrical portions 42, 44 within the valve orifices 22, 24 is a clearance fit but the clearance is relatively small. As will be appreciated, when cylindrical portion 42 enters valve orifice 22, it will substantially block flow through the orifice. In like fashion, when cylindrical portion 44 enters valve orifice 24 it will substantially block through the orifice 24.

Figure 2:
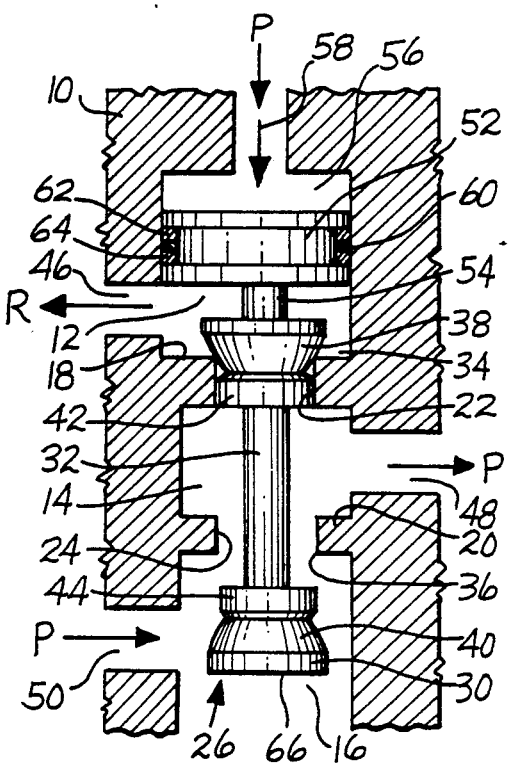
FIG. 2 is a view like FIG. 1, but showing a pilot piston at one end of the poppet member, and a pilot chamber endwise of the piston.

FIG. 2 illustrates the valve assembly of FIG. 1, but it in addition includes a piston 52 spaced endwise of valve plug 26, and connected to it by a connector 54. A fluid chamber 56 is defined in housing 10 endwise outwardly of piston 52. A fluid passageway 58 communicates with chamber 56. Piston 52 includes a peripheral groove in which is received a seal ring 60 that is flanked by a pair of spacer rings 62, 64. Seal ring 60 seals against leakage around the outer perimeter of the piston 52. In FIG. 2, cavity 60 is shown to be in constant communication with a source of pressure via passageway 50. Thus, cavity 16 may be termed a "pressure" cavity. Cavity 12 is in constant communication with a return line via passageway 46. Thus, cavity 12 may be termed the "return" cavity. Cavity 14 and its passageway 48, is either in communication with the pressure cavity or the return cavity 12, depending on the position of poppet 26. In the position illustrated, cavity 14 and passageway 48 are in communication With the pressure cavity 16. The engagement of valve surface 38 with valve seat 34 prevents pressure leakage from cavity 14 to cavity 12 via orifice 22. Chamber 56 is a pilot chamber. It is put into communication via passageway 48 with either a source of pressure, or a return line. In FIG. 2, chamber 56 is shown to be connected to a source of pressure. The pressure enters chamber 56 and acts on the end of piston 52. In cavity 16, all surfaces of valve plug 30 are subjected to pressure. In cavity 14 the end of cylindrical portion 22 is subjected to pressure. Owing to the size of piston 52, there is a pressure differential acting on piston 52 which forces the poppet 26 endwise, to place valve surface 38 into contact with valve seat 34, as illustrated. As long as pressure is maintained within chamber 56, the poppet 26 is held by the pressure differential in the position illustrated. When the pressure on piston 52 is removed, there is a directional change in the pressure differential. When chamber 56 is in communication with return pressure acting on end surface 66 of plug member 30 causes the poppet 26 to be moved endwise into its second position, placing valve surface 40 against valve seat 36 and spacing valve plug 28 and its cylindrical portion 42 endwise away from valve seat 34 and orifice 22. In this position, the engagement of valve surface 40 with valve seat 36 closes communication between cavities 14 and 16. The spacing of valve plug 28 and cylindrical portion 42 endwise away from valve seat 34 and orifice 22 opens communication between cavities 12 and 14, via valve orifice 22. During the shifting of the valve plug 26, in either direction, the engagement made between the cylindrical portions 42, 44 and the orifices 22, 24 prevents short circuiting of pressure from pressure cavity 16 to return cavity 12.

Figure 3:
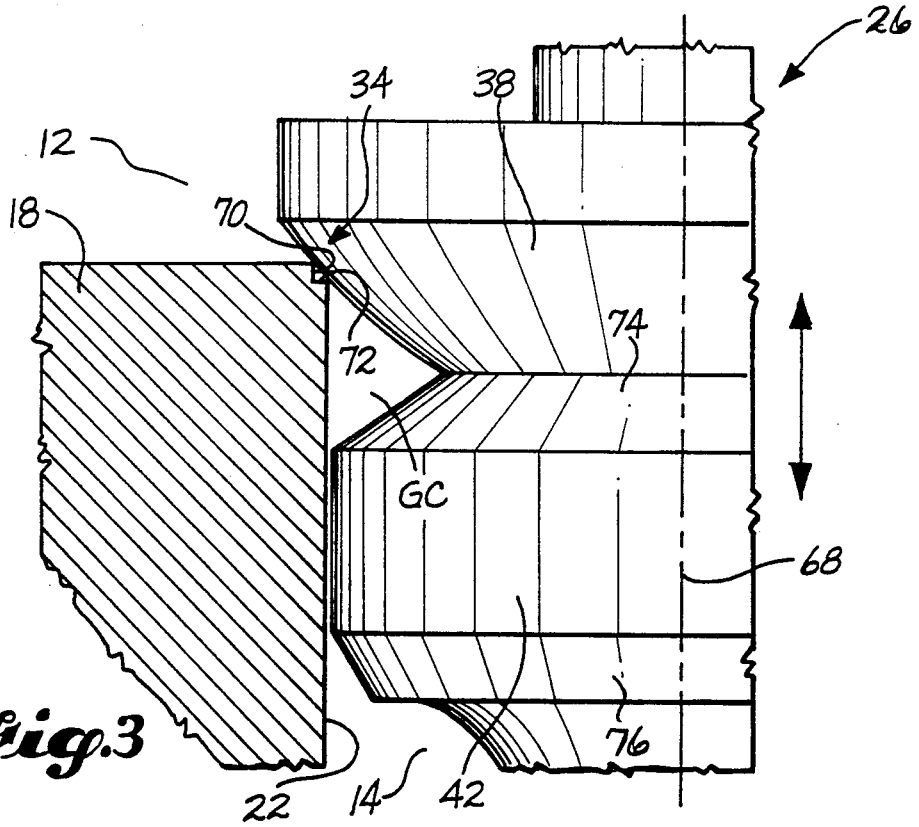
FIG. 3 is an enlarged scale fragmentary view showing a preferred construction of the valve seat, a closure surface on a valve plug portion of the poppet member, and a cylindrical portion extending endwise of the valve plug, positioned within a cylindrical portion of a valve orifice.

FIG. 3 illustrates the preferred construction of each plug member, valve orifice and valve seat. As will be evident, FIG. 3 is an enlarged scale view in the vicinity of valve seat 34, valve orifice 22 and valve plug 28. The valve surface 38 is substantially frustoconical in shape. In preferred form, surface 38 is slightly curved in the axial direction, with the center of curvature being on the centerline axis 68 endwise outwardly of valve plug 28. In preferred form, valve seat 34 is of stepped construction and comprises two closely spaced circular edges. The first edge is formed by the interconnection of the side of wall 18 that is directed towards cavity 12 and a short cylindrical wall 70. The second circular edge is formed by the intersection of orifice 22 and radial wall 72. As clearly shown by FIG. 3, valve surface 38 initially contacts the first edge, with the second edge being spaced from surface 38. Over a period of time there will be wear at the first edge and eventually, as the wear proceeds, there will be contact between surface 38 and the second edge. The type of wear involved can be characterized as a conforming of the valve surface to the valve seat, and vice versa.

As clearly shown by FIG. 3, the cylindrical portion 42 of valve plug 28 makes a snug clearance fit within the valve orifice 22. Valve surface 38 has a diameter at its small end which is substantially smaller than the diameter of cylindrical portion 42. Preferably, the opposite end parts 74, 76 of the cylindrical portion 42 are substantially frustoconical in shape.

The pounding of valve surface 38 against the valve seat edge may, over a period of time, deform the edge and create a lip on each side of the edge. The step construction prevents the radially inwardly directed lip from being in a position of interference with the movement of cylindrical portion 42. Such lip would instead extend into the end socket formed by surfaces 70 and 72. This construction allows the valve housing to be made from relatively soft metal, e.g. an aluminum alloy. Also, it is preferred that a grit cavity GC be formed between each valve surface 38, 40 and the adjacent cylindrical portion 42, 44. If grit exists in the system, it can be collected in the cavities GC, rather than between the valve surfaces 38, 40 and the valve seats 34, 36.

Figure 4:
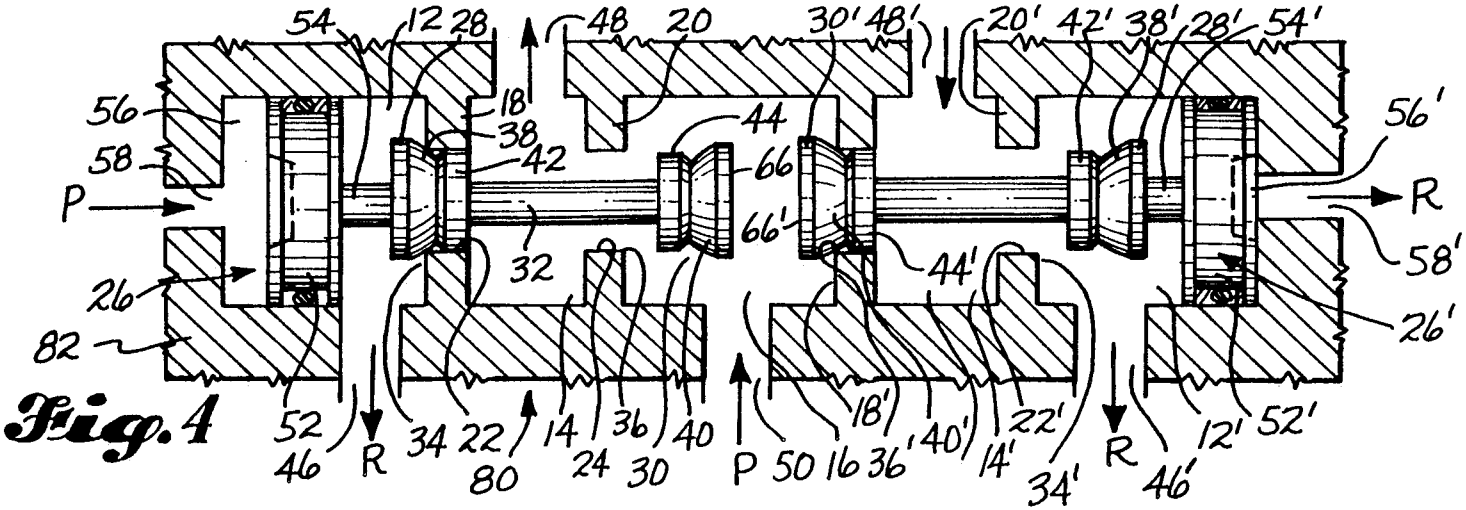
FIG. 4 is a diagrammatic view of a pressure/return switching valve constructed in accordance with the present invention, shown in a first position.
Figure 5:
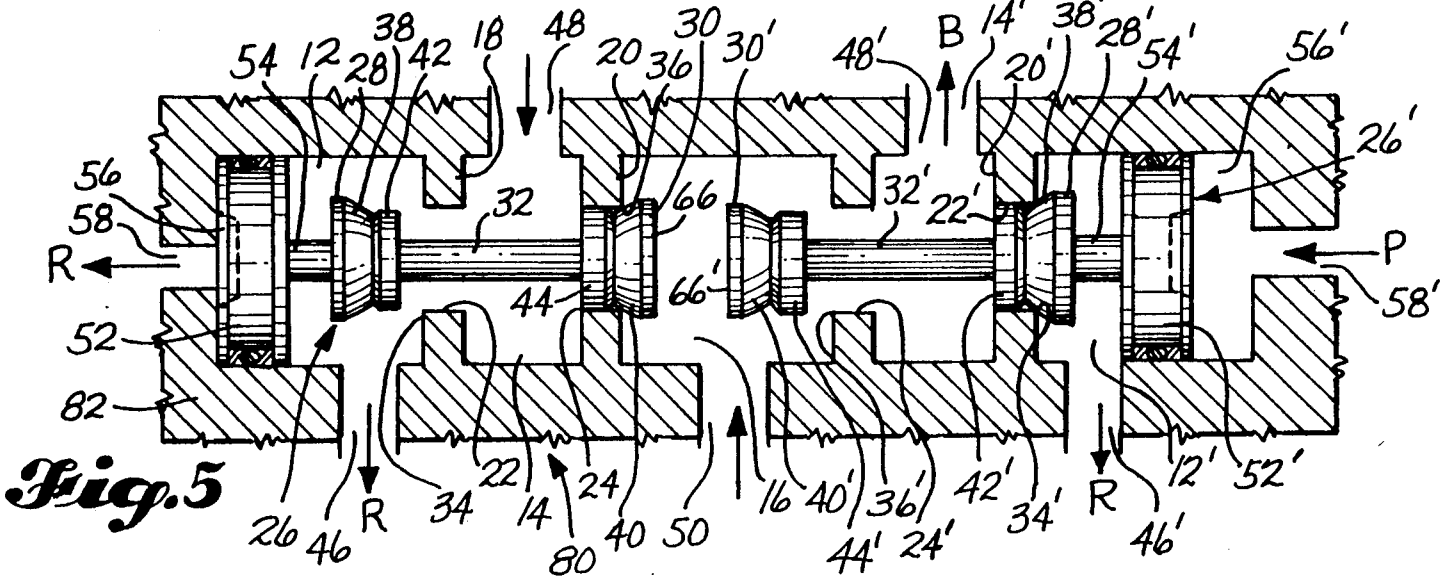
FIG. 5 is a view like FIG. 4, but showing the switching valve in a second position.

FIGS. 4 and 5 illustrate a pressure/return switching valve, composed of two of the valve assemblies shown in, and described with respect to, FIG. 2. In describing the switching valve 80, prime numbers will be used when referring to the components of the second poppet valve assembly. The housing for valve 80 is designed 82. Port 50 is connected to a source of hydraulic pressure. Ports 46, 46' are connected to tank or return. Port 48 is connected to one side of a cylinder or to a branch conduit extending to a common side of a plurality of cylinders. Port 48' is connected to the opposite side of the cylinder, or to a branch conduit extending to the opposite sides of a plurality of cylinders. As will be described below, in operation, one of the pilot chambers 56, 56' will be connected to pressure via its port 58 or 58', and the opposite pilot chamber 56 or 56' will be connected to return via its port 58 or 58'. During other times, both pilot chambers 56, 56' may be connected to return while cavity 16 is connected to pressure. When this happens, pressure in cavity 16, acting on end surfaces 66 and 66', will force the two poppets 26, 26' endwise outwardly, closing valve orifices 36, 36'. This will communicate both of passageways 48, 48' with return, via cavities 14, 14', valve orifices 22, 22', cavities 12,12', and ports 46, 46'. At other times, both of the pilot chambers 56, 56' may be connected to pressure. As a result, pressure acting on pilot pistons 52, 52', will create a pressure differential that will move the valve plugs 28, 28' into a seated or closed position, while opening valve orifices 24, 24'. This will communicate pressure in cavity 16 with both ports 48, 48', via the valve orifices 24, 24' and cavities 14, 14'.

In FIG. 4, pilot chamber 56 is shown to be connected to pressure while pilot chamber 56' is shown to be connected to return. The pressure differential acting on poppet 26 moves valve plug 28 into a seated position, closing orifice 22 and opening orifice 24. At the same time, pressure in cavity 16 acting on end surface 66' moves valve plug 26, endwise outwardly, seating valve plug 30'. Orifice 24' is closed and orifice 22' is open. Pressure from cavity 16 is connected to port 48 via valve orifice 24 and cavity 14. Port 48' is connected to return via cavity 14, orifice 22', cavity 12' and port 46'. FIG. 5 shows the position of the poppets 26, 26' when pressure and return is switched between the two pilot cavities 56, 56'. Valve plugs 28', 30 are seated, closing orifices 34' and 24 while opening orifices 36' and 22. This communicates pressure in cavity 16 with port 48', via orifice 24' and cavity 14'. Port 48 is connected to return, via cavity 14, orifice 22, cavity 12, and port 46. During the shifting in position of the poppets 26, 26', the cylindrical portions 42, 42', 44, 44' of the valve plugs 28, 28', 30, 30' prevent short circuiting of pressure from cavity 16 to either one of cavities 12, 12', as has been described above in conjunction with FIGS. 1 and 2.

Figure 6:
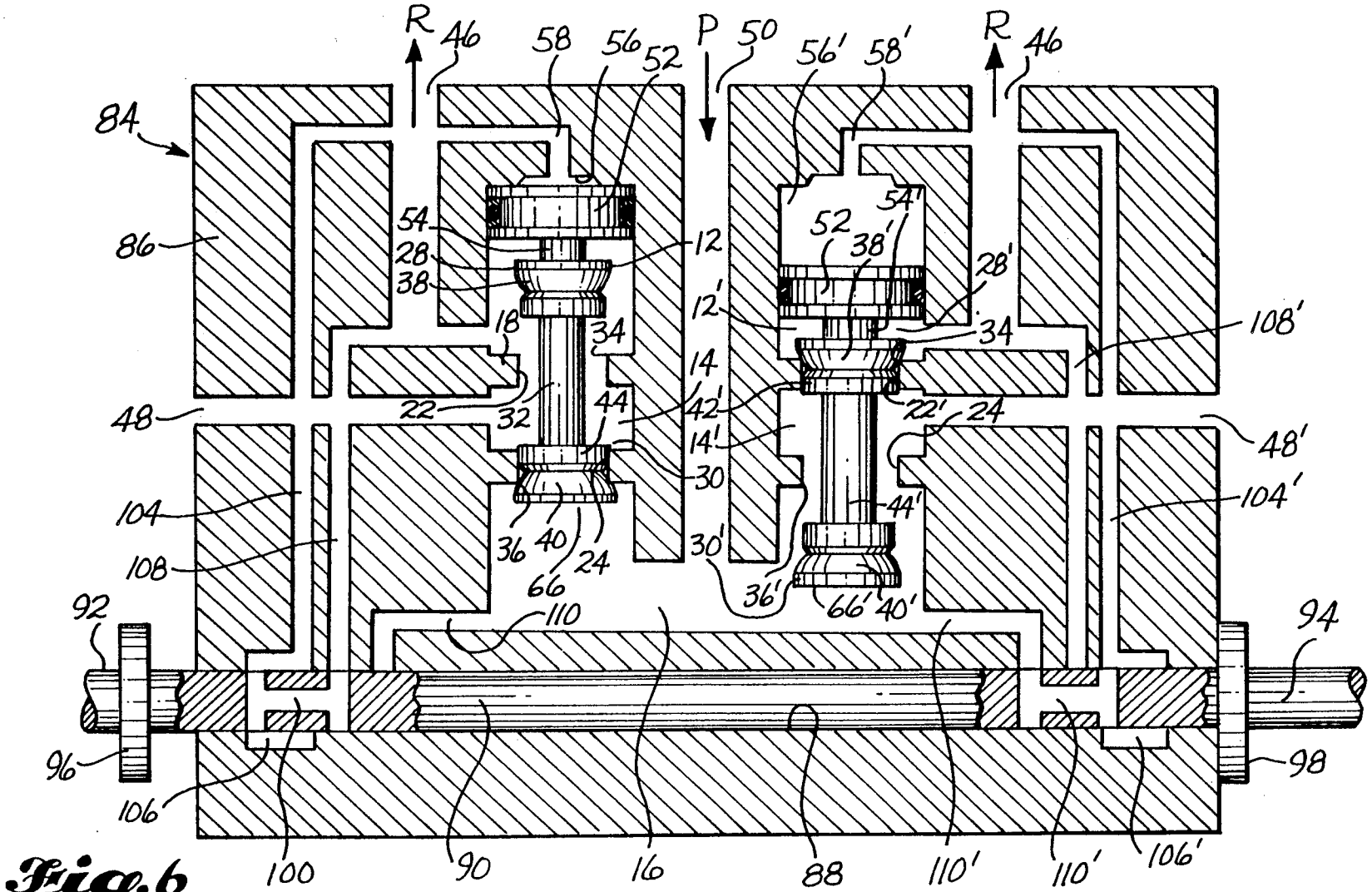
FIG. 6 is a diagrammatic view of a second embodiment of pressure/return switching valve which is constructed in accordance with the present invention, such view showing the valve housing in section, the poppet members in elevation, and a control rod partially in section and partially in elevation.

FIG. 6 shows a pressure/return switching valve 84 which includes a simple, very effective mechanism for switching pressure and return between the two pilot chambers 56, 56'. In FIG. 6 the valve housing is designated 86. In this embodiment, the housing 86 includes a cylindrical bore or chamber 88 in which an elongated control rod 90 is positioned. Control rod 90 includes opposite end portions 92, 94 which extend endwise outwardly from the housing 86. A stop member 96 is secured to end portion 92. Another stop member 98 is connected to end portion 94. The stop members 96, 98 are spaced apart a distance greater than the length of chamber 88. In operation, control rod 90 is moved in one direction to place stop 96 against the housing 86, and space stop 98 away from the housing 86, and a second position in which stop 98 is against the housing 86 and stop 96 is spaced away from housing 86. Control member 90 is formed to include a first passageway 100, located near stop 96, and a second passageway 102 located close to stop 98. In FIG. 6, the control rod 90 is shown in its second position, with stop 98 against housing 86 and stop 96 spaced from housing 86. In this position the control member passageway 100 communicates pilot chamber 56 with the return port 46. Specifically, in this embodiment, port 58 is a part of a passageway 104 which extends from pilot chamber 56 to an annular groove 106 which surrounds a portion of control rod 90. The passageway 100 in control rod 90 connects groove 106 with passageway 108. Passageway 108 extends to return port 56. At the same time, a portion of control rod 90 adjacent passageway 100 blocks and thus closes a passageway 110 which is connected to the pressure cavity 16. At the opposite end of the housing 86, passageway 102 communicates passageway 110' with annular chamber 106. This communicates pressure in cavity 16' with pilot chamber 56', via passageway 110', passageway 102, annular chamber 106', passageway 104' and port 58'. At the same time, a portion of control rod 90 adjacent passageway 102 blocks, and thus closes, passageway 108' which is connected to the return port 46'.

As can be clearly seen from FIG. 6, a simple and small endwise movement of control rod 90, in a direction placing stop 96 against housing 86 and moving stop 98 away from housing 86, shifts pressure and return between the two pilot chambers 56, 58. When stop 96 is against housing 86, passageway 100 communicates pilot chamber 56 with pressure cavity 16 and passageway 102 communicates pilot chamber 56' with return. Specifically, pressure in pressure cavity 16 is communicated via passageway 110, passageway 100, annular groove 106, passageway 104 and port 58, to pilot chamber 56. Pilot chamber 56' is connected to return port 46' via port 58', passageway 104', annular chamber 106'. passageway 102 and passageway 108'.

When pilot passageway 56 is connected to return, and pilot passageway 56' is connected to pressure, as illustrated, valve orifices 24 and 24' are open and valve orifices 22' and 24 are closed. Pressure cavity 16 is connected to port 48', via orifice 24' and cavity 14'. Port 48 is connected to return via cavity 14, valve orifice 22, cavity 12 and port 46. When pilot chamber 56 is connected to pressure and pilot chamber 56' is connected to return, valve orifices 22 and 24' are closed and valve orifices 22' and 24, are open. Pressure cavity 16 is connected to port 48 via valve orifice 24 and cavity 14. Port 48' is connected to return via cavity 14', valve orifice 22', cavity 12' and port 46'.

Figure 7:
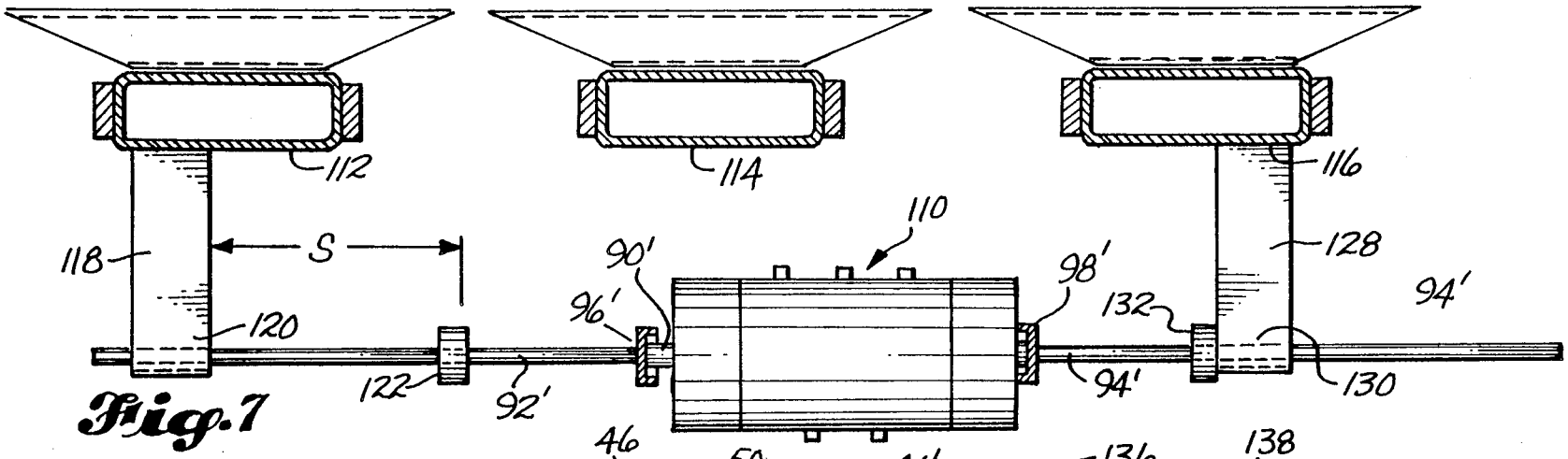
FIG. 7 is a side view of a portion of a reciprocating floor conveyor, including end views of three transverse drive beams, and showing a third type of pressure/-return switching valve.
Figure 8:
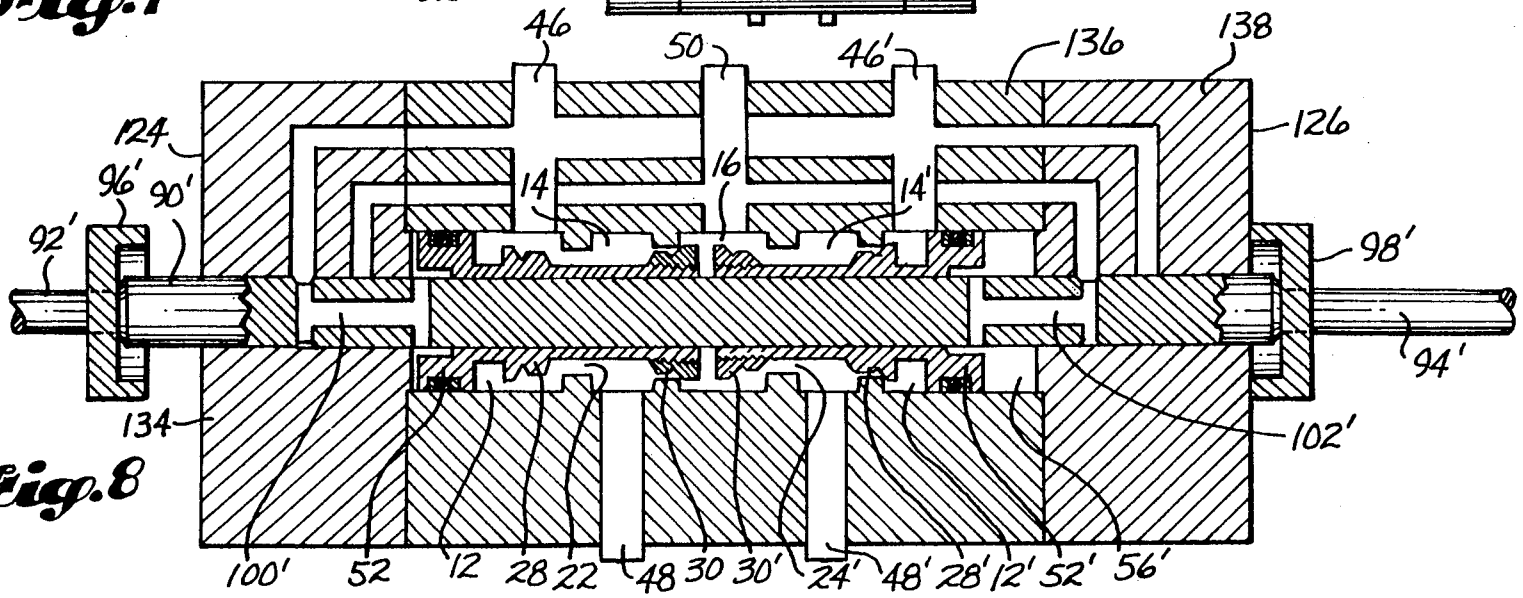
FIG. 8 is a longitudinal sectional view of the pressure/return switching valve shown in FIG. 7.
Figure 9:
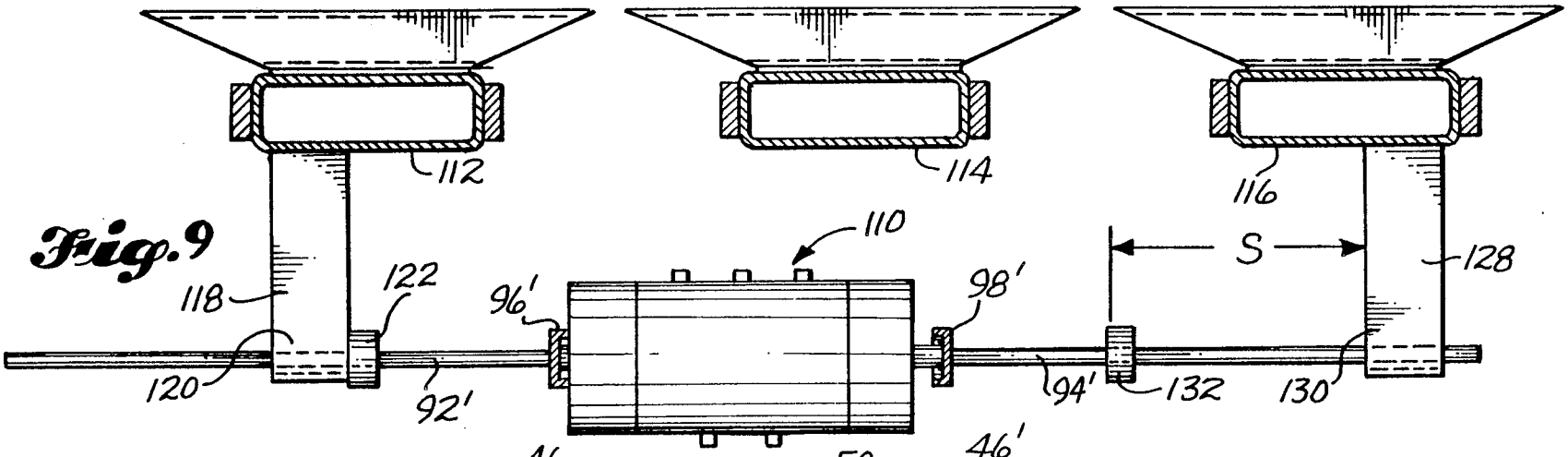
FIG. 9 is a view like FIG. 7, but showing the parts of the reciprocating floor conveyor moved to the right, and the switching valve in a second position.

FIGS. 7 and 9 illustrate a further embodiment of the pressure/return switching valve, designated 110, as a part of a reciprocating floor conveyor. Example reciprocating floor conveyors are disclosed by my U.S. Pat. No. 4,748,894, granted June 7, 1988 and entitled Drive/-Frame Assembly For A Reciprocating Floor, and by my U.S. Pat. No. 4,962,848, granted Oct. 16, 1990, and entitled Reciprocating Floor Conveyor. In FIGS. 7 and 9, the members 112, 114, 116 are transverse drive beams to which the floor slat members are connected as disclosed in U.S. Pat. No. 4,748,894. One-third of the floor slat members are connected to drive beam 112. A second third of the floor slat members are connected to drive beam 114. The remaining third of the floor slat members are connected to drive beam 116. The hydraulic drive system includes a piston-cylinder unit for each drive beam 112, 114, 116. The three piston-cylinder units are moved in unison, to move all of the slat members together, in the conveying direction. The piston-cylinder units are operated in the reverse direction, one at a time, for returning the slat members to their start position, one-third at a time. Referring to FIG. 7, in the conveyor the position of switching valve 110 is fixed. The transverse drive beams 112, 114, 116 are shown in the position they occupy when the floor slat members are in their start position. The switching valve 110 is positioned to cause delivery of hydraulic fluid to all three piston-cylinder units, for causing simultaneous movement of the three transverse drive beams 112, 114, 116, and all of the floor slat members of the conveyor. The trailing beam 112 includes a depending control arm 118 which includes a control rod engaging portion 120 at its lower end. The stroke length of the piston-cylinder units is designated "S" in FIG. 7. The leading edge of arm 118 moves this distance at the same time that each of the piston-cylinder units and each of the drive beams 112, 114, 116 move the same distance. As will be evident, shortly before reaching the end of its path of travel, the arm 118 will, at its forward edge, contact a bumper 122 which is secured to the control rod 90'. Following contact, arm 118 will continue to move and will move with it the bumper 122, and the control rod 90'. This movement will move stop member 96' into contact with the end 194 of housing 110, and at the same time will move stop member 98' away from the end surface 126 of housing 110. This will shift the valve 110 from the position shown in FIG. 8 to the position shown in FIG. 10. As explained in U.S. Pat. No. 4,748,894, the transverse drive beams 112, 114, 116 are returned to their start position, one at a time, starting with beam 112. Starting from the position shown in FIG. 9, beam 112 is moved to the left the distance "S". Then, beam 114 is moved to the left the distance "S". Lastly, beam 116 is moved to the left the distance "S". Beam 116 includes a second control arm 128 which depends from beam 116 and at its lower end includes a control rod engaging portion 130. As can be seen from FIG. 9, the leading edge of arm 128 will contact the bumper 132 before the beam 116 reaches the end of travel. Following contact, the arm 128 will move with it the bumper 132 and the control rod portion 94' to which the bumper 132 is connected. The bumper and the control rod will move a sufficient distance to again place stop member 98' against end surface 126 of housing 110, and again move stop member 96' away from end surface 124. This movement switches the valve 110 from the position shown in FIG. 10 to the position shown in FIG. 8.

The operation of switching valve 110 is essentially identical to the operation of switching valve 84. The difference involves the manner in which the valve is constructed valve 110 includes a three part housing. The parts are a first end part 134, a center part 136 and a second end part 138.

When switching valve 10 is in the position shown by FIG. 8, valve plugs 30 and 28, are seated and valve orifices 22 and 24 are open. Pressure cavity 116 is connected to port 48' via orifice 24 and cavity 14'. Port 48 is connected to return via cavity 14, valve orifice 22, cavity 12, and port 48. When switching valve 110 is in the position shown by FIG. 10, valve plugs 28 and 30' are seated and valve orifices 24 and 22' are open. Pressure cavity 16 is connected to port 48 via valve orifice 24 and cavity 14. Port 48' is connected to return via cavity 14', orifice 22', cavity 12, and port 46'. In valve 110, control rod 90, functions in the same manner as control rod 90 described above in connection with the embodiment of FIG. 6. Accordingly, there is no need to again describe the function of the control rod 90'. As before, it is moved back and forth endwise, to switch pressure and return between the two pilot cavities 56, 56'.

Figure 10:
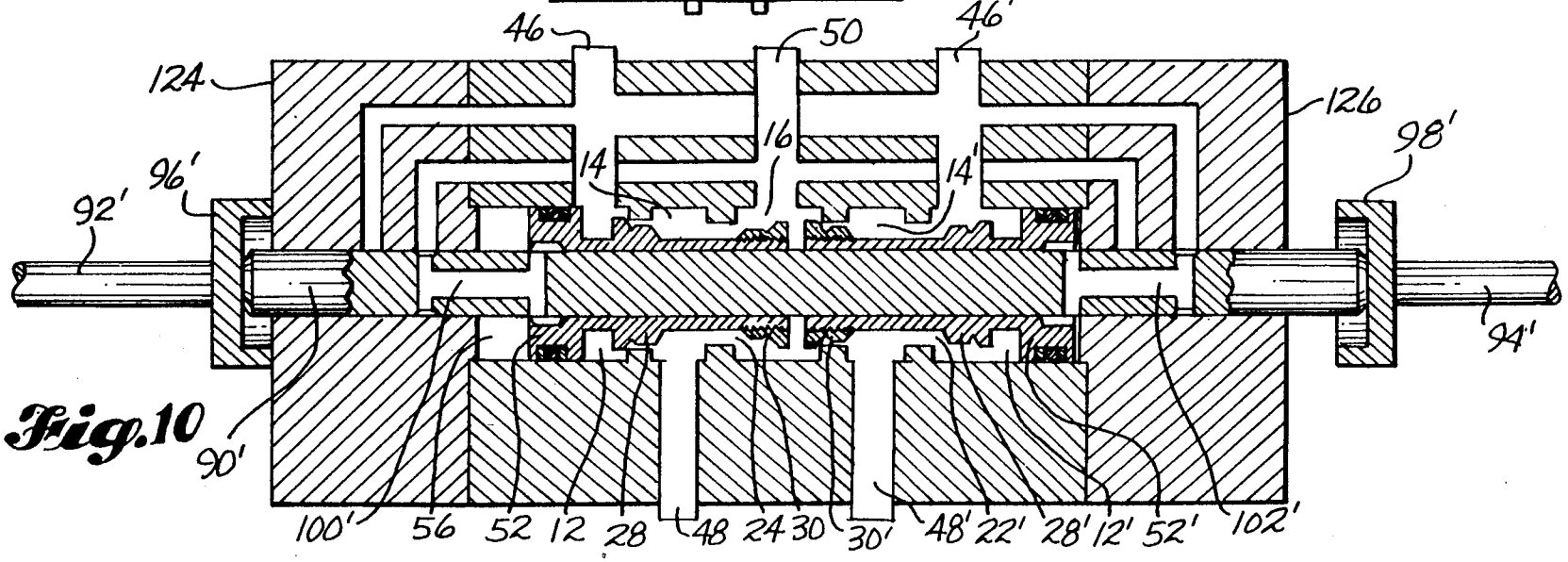
FIG. 10 is a view like FIG. 8, but showing the switching valve in the second position.

Switching valve 110 is the preferred embodiment. The manner of its construction will now be described, with particular reference to FIG. 11. The various cavities, divider walls, valve orifices and valve seats are machined into the central housing 136. As best shown in FIGS. 8 and 10, the pilot chambers 56, 56', the cavities 12, 12', 14, 14', 16, and the valve orifices 22, 22' and 24, 24' are all coaxial within housing part 136. The two housing end parts 134, 138 form outer end walls for the pilot chambers 56, 56'. In this embodiment, a central portion of control rod 90' extends concentrically through the poppet members 26*a*, 26*b*. Housing end parts 134, 138 include central bores in which the end portions of control member 90' are received.

Figure 11:
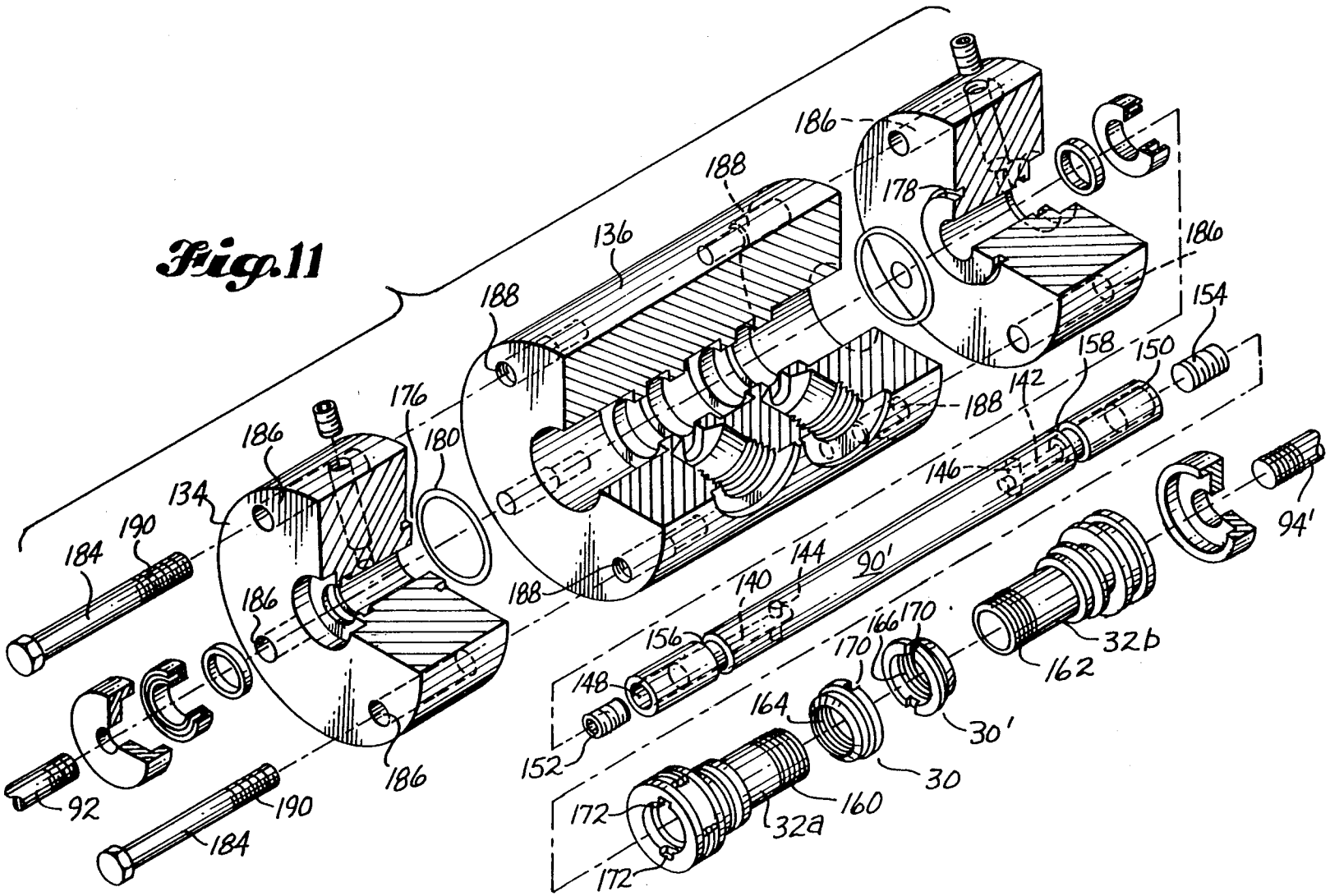
FIG. 11 is an exploded isometric view of the switching valve shown by FIGS. 7-10.

As shown by FIG. 11, the passageways 100', 102' can be easily formed in control rod member 90', in the following manner. A passageway 140 is drilled endwise into one end of member 90'. A similar passageway 142 is drilled endwise into the opposite end of member 90'. A cross passageway 142 is drilled end of member 90', across the inner end portion of passageway 40. A similar cross passageway 146 is drilled through member 90', across the inner end portion of passageway 142. The outer end portions 148, 150 of passageways 140, 142 are enlarged and are internally threaded, for reception of closure plugs 152, 154. An annular groove is formed around member 90', between the plug location 152 and the cross passageway 146. Groove 156 is put into communication with passageway 140 by way of one or more radial ports. In similar fashion, an annular groove 158 is formed around member 90', between the location of plug 154 and the cross passageway 146. Groove 156 is put into communication with passageway 142, by means of one or two radial ports. The groove 156, the radial ports, the passageway 140 and the cross passageway 140' together define passageway 100'. The annular groove 158, the radial ports, the passageway 142 and the cross passageway 146 together define the passageway 102'.

The closure plugs 152, 154 are screwed into the end regions 148, 150 a sufficient distance to provide threads outwardly of each plug 152, 154, for receiving threads at the ends of control rod portions 92', 94'.

Ports 48, 48' may be easily formed by drilling radial holes part way into housing part 146. The hole forming port 48 is drilled towards cavity 114. The hole forming port 48' is drilled towards cavity 14'. An end wall is left at the inner end of each drilled hole and a smaller opening is provided in each end wall. The outer end of each drilled hole is internally threaded to receive external threads on a fitting that is at the end of a fluid conduit.

Figure 14:
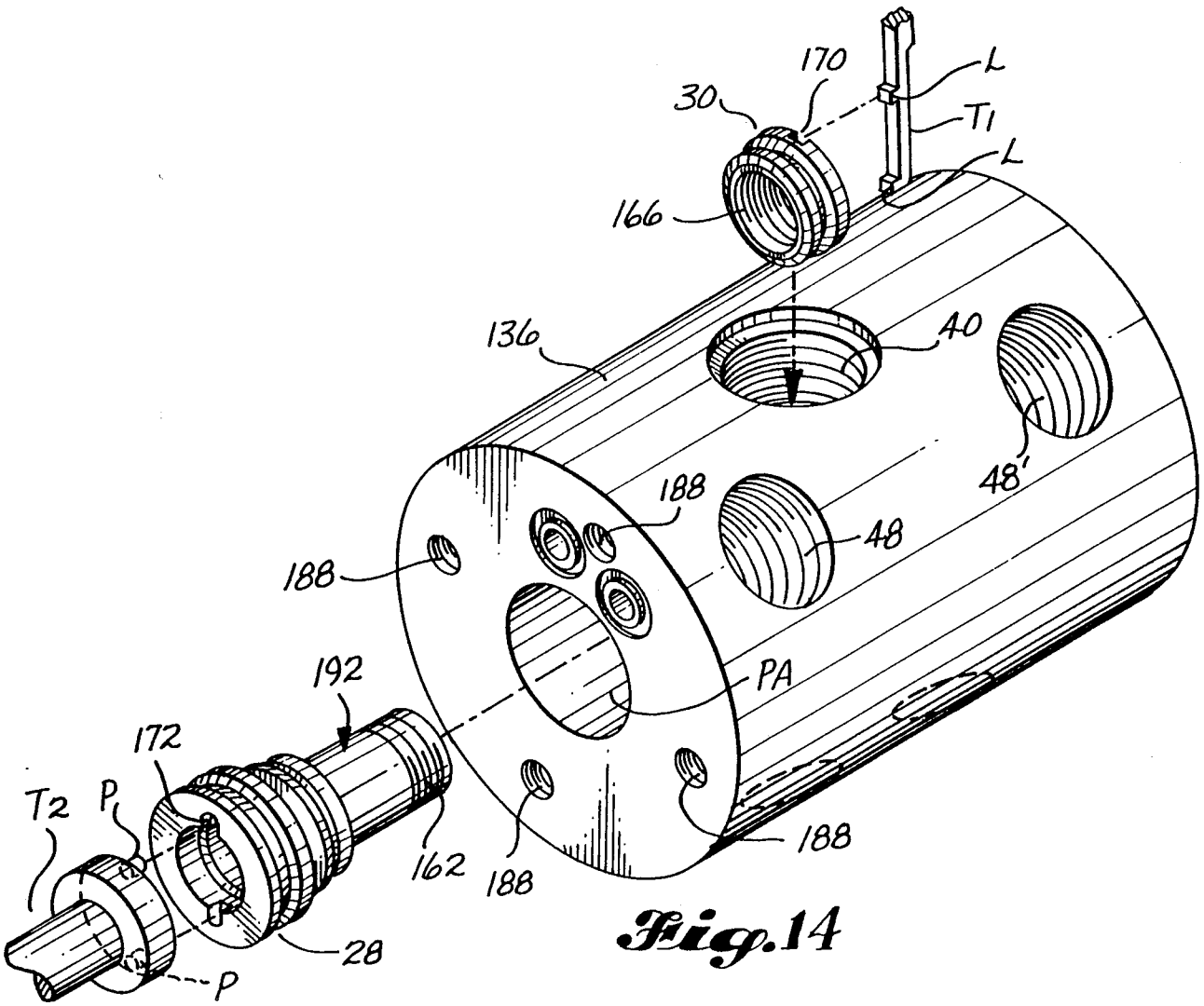
FIG. 14 is a pictorial view of the valve housing with the two pieces of a poppet member and some installation tools shown in a spaced relationship to openings in said housing.

In the construction of the poppets 26*a*, 26*b*, the valve plugs 30, 30' are constructed to be detachably connected to the rest of the poppet 26, 26'. Specifically, an end portion of the connector 32*a*, 32*b* is threaded at 160, 162. Valve plugs 30, 30' are each constructed to be in the form of a ring having internal threads 164, 166. Threads 164 of valve plug 30 mate with threads 160 on connector portion 32*a*. Threads 166 within valve plug 30' mate with threads 162 on connector portion 32. As shown in FIGS. 14 and 15, a radial access opening is formed in housing part 136. This access opening 168 communicates with pressure cavity 16. It is sized to permit movement of a valve plug 30 or 30', one at a time, both into and out from the cavity 16. The poppet members 26*a*, 26*b*, minus valve plugs 30, 30', are inserted into the central opening in housing part 138, each from an opposite end of the central opening. By way of example, valve plug 30 may be inserted through opening 168 into cavity 16. Then, the remaining portion of poppet member 26*a* is inserted into the central opening, from its end of the central opening. It is moved endwise to move the threaded end portion 160 through first valve orifice 22 and then valve orifice 24, to place end portion 160 into cavity 16. Valve plug 30 includes radial slots 170 which receive the tip of a holding tool. Piston 52 includes slots 172 for receiving the tip of a turning tool. Valve plug 30 is held and the remaining portion of poppet member 26*a* is rotated, until threads 160 are sufficiently mated with threads 164, and the valve plug 30 is secured to the connector portion 32*a*. Then, the assembled poppet member 26*a* is moved endwise outwardly, into the position shown by FIG. 8. Next, valve plug 30' is installed through the opening 168, and the remaining portion of poppet 26*b* is installed through its end of the central opening in housing 136, and the two parts are mated at the threads 162, 166, in the manner described above. Then, a closure plug 174 is installed into the access opening 168, to close such opening 168. Next, the end parts 134, 136 are installed. Each end part includes an annular seal groove 176, 178, into which is received a seal ring 180, 182. As will be apparent, seal rings 180, 182 seal against leakage out from cavities 12, 12', through the separations between the housing parts 134, 136, 138. Per conventional practice, the housing end parts 134, 138 are connected to housing part 136 by means of connector bolts 184. Axial openings 186 are drilled through the end parts 134, 138. Each bolt hole 186 communicates with an internally threaded axial opening 188 in an end portion of housing part 136. The bolts 184 are inserted through the openings 186 to place their threaded end portions 190 into initial engagement with the threaded openings 188. Then, the bolts 184 are rotated, to complete the assembly. When the bolts 184 are tightened the seal rings 180, 182 are compressed, and a seal is established between each end part 134 and its end of the housing central part 136.

The longitudinal and radial passageways in housing parts 134, 136, 138, which define the fluid passageways which communicate with control rod passageways 100', 102', are easily formed by drilling intersecting axial and radial passageways, and then closing end portions of the drilled passageways, where needed, by use of plugs. This is a known method of forming fluid passageways in the housings of hydraulic devices.

Figure 12:
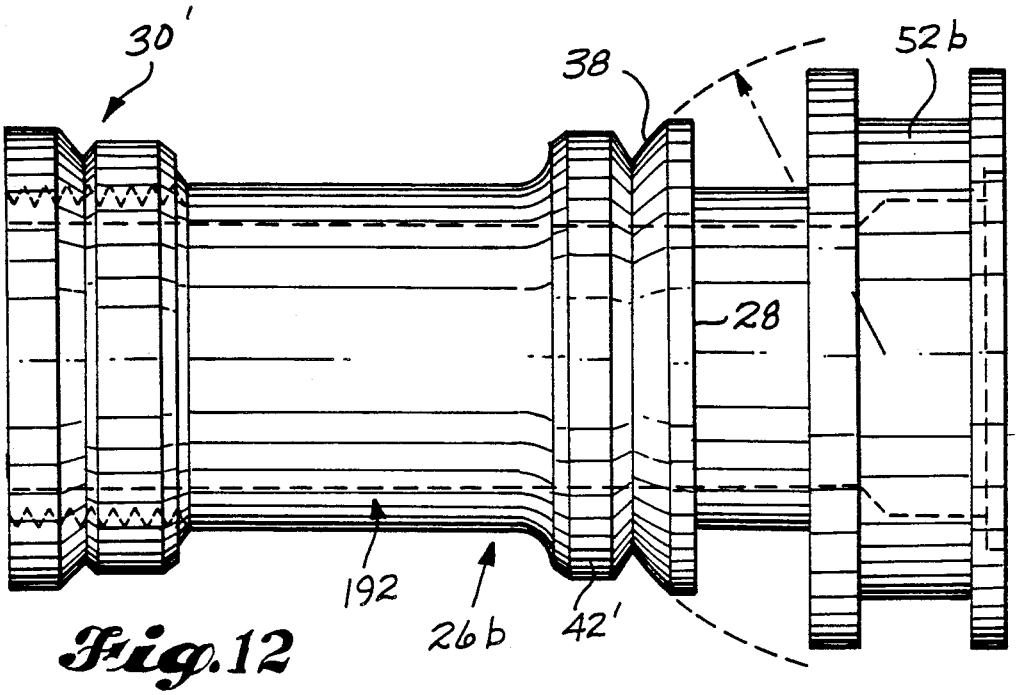
FIG. 12 is an enlarged scale elevational view of a double plug poppet member that is used in the embodiment shown by FIGS. 7-11.
Figure 13:
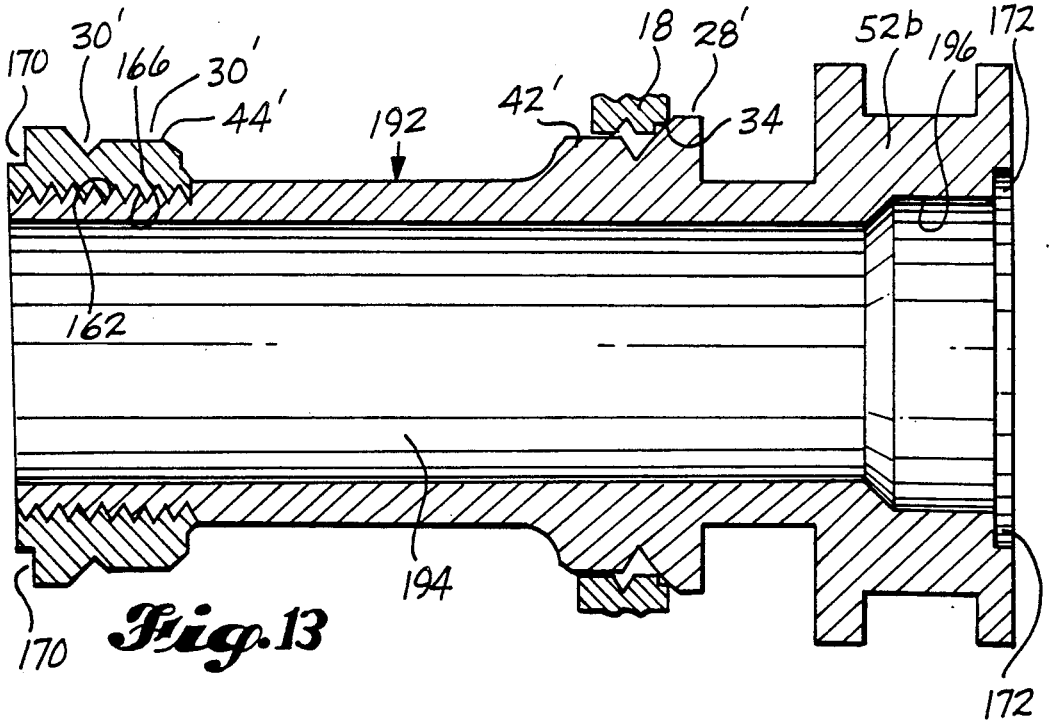
FIG. 13 is a longitudinal sectional view of the double plug poppet member shown by FIG. 12.

FIGS. 12 and 13 illustrate the preferred construction of the poppet members used in the preferred embodiment. All poppet members are identical, and so only poppet member 26*b* will be described. Referring first to FIG. 13, a single piece of metal is machined to form a main body 192. Main body 192 includes the pilot piston 52*b* at one end, and an opposite end portion which is externally threaded at 162. The center of member 192 is open, forming a control rod receiving passageway 194. In the region of piston 52b, the diameter of the passageway is enlarged, to form an end cavity 196. As shown in FIG. 8, this end cavity 196 is in communication with passageway 102' in control rod portion 90'. The end cavity 196 provides an open annular region surrounding control rod portion 90', through which fluid pressure communication occurs, between pilot chamber 56, and passageway 102'.

Valve plug 28 is formed on poppet body 192, endwise of piston 52'. In FIG. 13, the valve plug 30, is shown to be connected to valve body 192, by engagement between its threads 166 and the threads 162 on the end portion of poppet body 192. Valve plug 28' and valve plug 30', including the cylindrical portions 42', 44', are constructed in the manner described above with reference to FIG. 3 of the drawing. The relationship of the valve plugs 28', 30', and their cylindrical portions 42', 44', to the valve seat and to the valve orifice, is as described above with reference to FIG. 3.

FIG. 14 shows the central portion 136 of the valve housing, and the components 28', 30' of a poppet member positioned for insertion into the housing part 136. An access opening AO extends radially into housing part 136, in communication with the center cavity 16. The access opening AO is normally closed by a plug (not shown) which threads into the opening AO, to form a closure for its side of the cavity 16. The valve plug member 30' is inserted through opening AO into the cavity 16, together with the inner end portion of a first tool T1. As shown by FIG. 14, tool T1 includes a pair of spaced apart lugs L. The lugs L extend into the tool recesses 170 in the valve plug member 30'. As shown by FIG. 16, the lugs L of tool T1 are inserted into the tool recesses 170 in member 30'. Then, member 30' and tool T1 are inserted into the opening AO, to position the threaded opening 166 in member 30' in alignment with the passageway PA which extends lengthwise of housing member 136. The main body portion 192 of the poppet member is inserted into the passageway PA, with threaded end portion 162 directed towards the threaded opening 166. Pins P on a second tool T2 engage with pin recesses 172 in the outer end of member 192. The poppet part 192 and the second tool T2 are moved endwise to place threaded end portion 162 into contact with the threads 166. Then, with member 30, being held in position by tool T1, the tool T2 is rotated for the purpose of rotating member 192 and screwing threads 162 into threads 166. Tool T2 is rotated until poppet members 192 and 30' are completely screwed together. Then, tool T1 is moved out from the access opening AO and tool T2 is moved out from passageway PA. The assembled poppet member is then moved endwise outwardly in passageway PA. This movement positions the plug member 30' out of alignment with the access opening AO. This allows poppet member 30' to be inserted through the access opening AO into the center cavity 16, in position to be connected to part 192 of the other poppet member. As before, part 30' and tool T1 are moved to position part 30' in alignment with the passageway PA. Then, the main body portion 192 of the poppet member is inserted through the second end of passageway PA, and its threaded end portion 162 is threaded into the threads 166 in member 30'.

Figure 17:
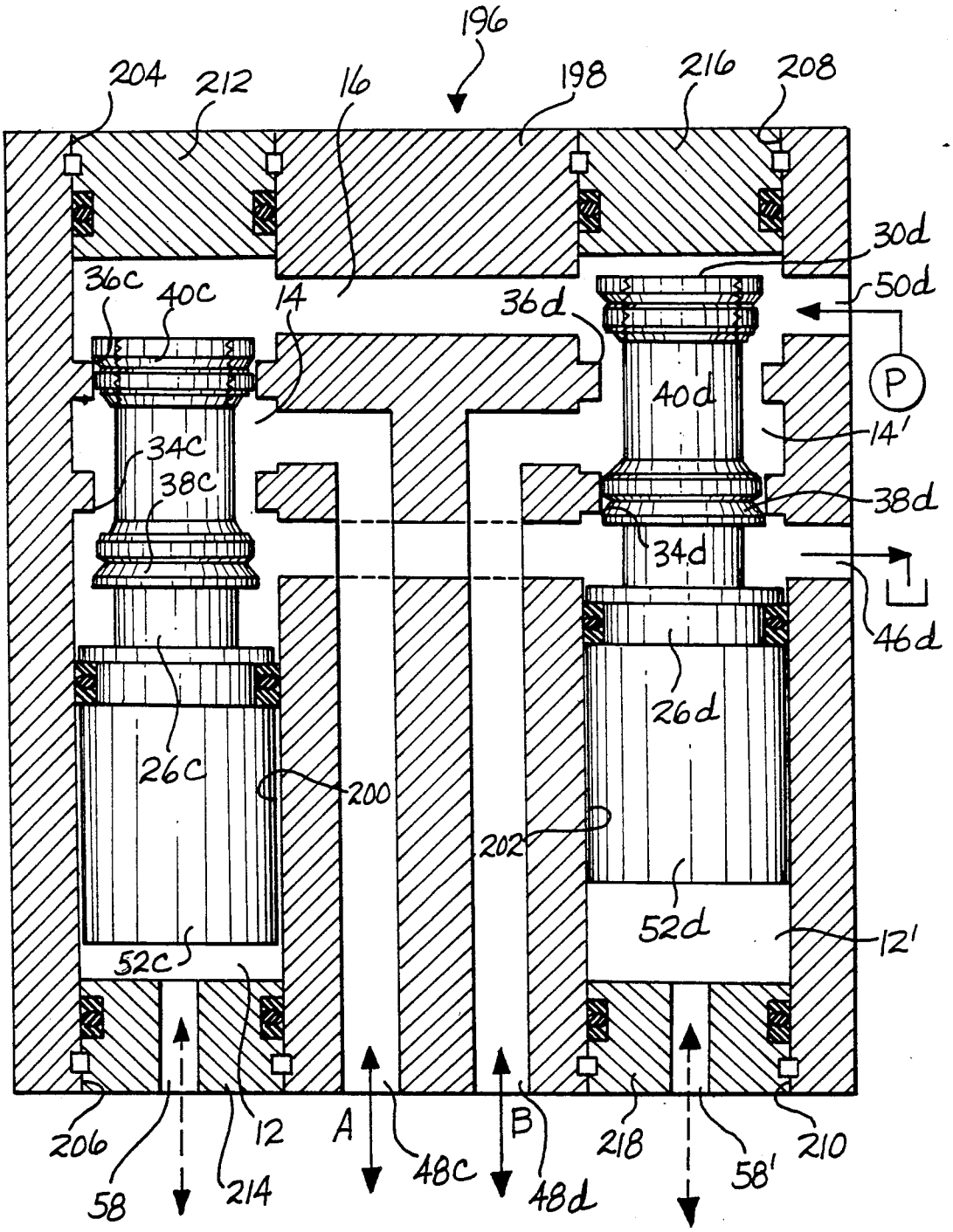
FIG. 17 is a longitudinal sectional view of a fourth embodiment of the pressure/return switching valve.

FIG. 17 illustrates yet another embodiment of the switching valve. Such embodiment is designated 196. The housing is designated 198. In this embodiment, the two poppet members 26c, 26b, are parallel to each other, within parallel cavity regions 200, 202, which are machined in the housing 198. Each cavity region 200, 202 includes a pair of access openings, one at each of its ends. The access openings for cavity region 200 are designated 204 and 206. The access openings for cavity region 202 are designated 208 and 210. The access openings 204, 206, 208, 210 are closed by plug members 212, 214, 216, 218. In this embodiment, the outer end portion of the pilot pistons 52c, 52d have a substantially longer axial dimension than the outer end portions of the previcusly described pilot pistons. In other respects, the poppets 26c, 26d are essentially identical to the poppets described above in connection with FIGS. 1-6. As should be apparent, the main body portion of the poppets 26c, 26d are installed through access openings 206, 210. The rings which include valve plugs 30, 30' are installed through access openings 204, 208.

In operation, as in the earlier embodiments, pilot pressure may be inserted into chamber 12 via passageway 58 while at the same time chamber 12' is connected to return via passageway 58'. The system pressure acting on the pilot piston 52c shifts the poppet 26c in position, moving valve surface 38c against valve seat 34c while moving valve surface 40c away from contact with valve seat 36c. At the same time, the system pressure within cavity 16, acting on the end of valve plug 30d, moves valve surface 40d into oontact with valve seat 36d and moves valve surface 38d away from oontact with valve seat 34d. This shifting of the poppet valve members 26c, 26d communicates pressure chamber 16 with passageway 48c while at the same time passageway 48d is connected to return via port 36d. As will be evident, a reverse movement of the poppet members 26c, 26d into the position shown by FIG. 16, will communicate passageway 48c with return and will communicate passageway 48d with pressure. Any suitable mechanism may be used for switching between pressure and return in the two pilot chambers 12, 12'.

The illustrated embodiments are presented for the purpose of providing examples of the invention. The scope of protection is not to be limited to the illustrated examples. Rather, the scope of protection is to be determined by the claims which follow, interpreted in accordance with the established rules of patent claim interpretation, including use of the doctrine of equivalents.

What is claimed is:

1. A switching valve for switching hydraulic pressure and return between first and second cylinder passageways, said valve comprising:

a first end cavity having a first end wall;

a first cylinder cavity;

a first divider wall between said first end cavity and said first cylinder cavity, said first divider wall including a first valve orifice;

a pressure cavity;

a second divider wall between said first cylinder cavity and said pressure cavity, said second divider wall including a second valve orifice;

a second cylinder cavity including a sidewall;

a third divider wall between said pressure cavity and said second cylinder cavity, said third divider wall including a third valve orifice;

a second end cavity;

a fourth divider wall between said second cylinder cavity and said second end cavity, said fourth divider wall including a fourth valve orifice;

said first divider wall including a first valve seat bordering the first valve orifice and directed towards said first end cavity;

said second divider wall including a second valve seat bordering the second valve orifice and directed towards said pressure cavity;

said third divider wall including a third valve seat bordering the third valve orifice and directed towards said pressure cavity;

said fourth divider wall including a fourth valve seat bordering the fourth valve orifice and directed towards said second end cavity;

a first poppet including a first piston and a first valve plug in said first end cavity, a second valve plug in said pressure cavity, a first connector portion interconnecting said first piston and said first valve plug, and a second connector portion interconnecting said first valve plug and said second valve plug, said first piston including an end surface directed towards said first end wall, said first valve plug including a generally conical first closure surface directed towards the first valve seat, said second valve plug including a generally conical second closure surface directed towards said second valve seat, said second valve plug including an end surface directed towards said pressure cavity, said end surface on said first piston being larger in area than said end surface on said second valve plug;

a second poppet including a second piston and a third valve plug in said second end cavity, a fourth valve plug in said pressure cavity, a third connector portion interconnecting said second piston and said third valve plug, and a fourth connector portion interconnecting said third valve plug and said fourth valve plug, said second piston including an end surface directed towards said second end wall, said third valve plug including a generally conical third closure surface directed towards the fourth valve seat, said fourth valve plug including a generally conical fourth closure surface directed towards the third valve seat, and said fourth valve plug including an end surface directed towards said pressure cavity, said end surface on said second piston being larger in area than said end surface on said fourth valve plug;

a pressure delivery passageway communicating with said pressure cavity;

a first return passageway communicating with said first end cavity, adjacent said first divider wall;

a second return passageway communicating with said second end cavity, adjacent said fourth divider wall;

a first cylinder passageway communicating with said first cylinder cavity;

a second cylinder passageway communicating with said second cylinder cavity;

a first pilot passageway communicating with the first end cavity, between the first end wall and the end surface of the first piston;

a second pilot passageway communicating with the second end cavity, between the second end surface and the end surface of the second piston; and control means having a first position in which the first pilot passageway is connected to pressure and the second pilot passageway is connected to return, and a second position in which the second pilot passageway is connected to pressure and the first pilot passageway is connected to return, wherein when the control means is in said first position, the first valve plug is seated on the first valve seat, closing the first valve orifice, the second valve plug is spaced from the second valve seat, opening the second valve orifice and connecting the pressure cavity to the first cylinder passageway, the fourth valve plug is seated on the third valve seat, closing the third valve orifice, and the third valve plug is spaced from the fourth valve seat, opening the fourth valve orifice and connecting the second cylinder passageway with return, and wherein when the control means is in said second position, the second valve plug is seated on the second valve seat, closing the second valve orifice, the first valve plug is spaced from the first valve seat, opening the first valve orifice and connecting the first cylinder passageway with return, the third valve plug is seated against the fourth valve seat, closing the fourth orifice, and the fourth valve plug is spaced from the third valve seat, opening the third valve orifice and connecting the pressure cavity to the second cylinder passageway.

2. A switching valve, comprising:

a first end cavity having a first end wall;

a first cylinder cavity;

a first divider wall between said first end cavity and said first cylinder cavity, said first divider wall including a first valve orifice;

a pressure cavity;

a second divider wall between said first cylinder cavity and said pressure cavity, said second divider wall including a second valve orifice;

a second cylinder cavity including a sidewall;

a third divider wall between said pressure cavity and said second cylinder cavity, said third divider wall including a third valve orifice;

a second end cavity;

a fourth divider wall between said second cylinder cavity and said second end cavity, said fourth divider wall including a fourth valve orifice;

said first divider wall including a first valve seat directed towards said first end cavity;

said second divider wall including a second valve seat directed towards said pressure cavity;

said third divider wall including a third valve seat directed towards the pressure cavity;

said fourth divider wall including a fourth valve seat directed towards said second end cavity;

a first poppet including a first piston and a first valve plug in said first end cavity, a second valve plug in said pressure cavity, a first connector portion interconnecting said first piston and said first valve plug, and a second connector portion interconnecting said first valve plug and said second valve plug, said first piston including an end surface directed towards said first end wall, said first valve plug including a closure surface directed towards the first valve seat, said second valve plug including a closure surface directed towards said second valve seat, said second valve plug including an end surface directed towards said pressure cavity, said end surface on said first piston being larger in area than said end surface on said second valve plug;

a second poppet including a second piston and a third valve plug in said second end cavity, a fourth valve plug in said pressure cavity, a third connector portion interconnecting said second piston and said third valve plug, and a fourth connector portion interconnecting said third valve plug and said fourth valve plug, said second piston including an end surface directed towards said second end wall, said third valve plug including a closure surface directed towards the fourth valve seat, said fourth valve plug including a closure surface directed towards the third valve seat, and said fourth valve plug including an end surface directed towards said pressure cavity, said end surface on said second piston being larger in area than said end surface on said fourth valve plug;

a pressure delivery passageway communicating with said pressure cavity;

a first return passageway communicating with said first end cavity, adjacent said first divider wall;

a second return passageway communicating with said second end cavity, adjacent said fourth divider wall;

a first cylinder passageway communicating with said first cylinder cavity;

a second cylinder passageway communicating with said second cylinder cavity;

a first pilot passageway communicating with the first end cavity, between the first end wall and the end surface of the first piston;

a second pilot passageway communicating with the second end cavity, between the second end surface and the end surface of the second piston; and control means having a first position in which the first pilot passageway is connected to pressure and the second pilot passageway is connected to return, and a second position in which the second pilot passageway is connected to pressure and the first pilot passageway is connected to return, wherein when the control means is in said first position, the first valve plug is seated on the first valve seat, closing the first valve orifice, the second valve plug is spaced from the second valve seat, opening the second valve orifice and connecting the pressure cavity to the first cylinder passageway, the fourth valve plug is seated on the third valve seat, closing the third valve orifice, and the third valve plug is spaced from the fourth valve seat, opening the fourth valve orifice and connecting the second cylinder passageway with return, wherein when the control means is in said second position, the second valve plug is seated on the second valve seat, closing the second valve orifice, the first valve plug is spaced from the first valve seat, opening the first valve orifice and connecting the first cylinder passageway with return, the third valve plug is seated against the fourth valve seat, closing the fourth orifice, and the fourth valve plug is spaced from the third valve seat, opening the third valve orifice, connecting the pressure cavity to the second cylinder passageway;

wherein said first valve orifice includes a cylindrical portion, said second valve orifice includes a cylindrical portion, said third valve orifice includes a cylindrical portion, said fourth valve orifice includes a cylindrical portion, said first valve plug includes a cylindrical portion sized to snugly fit within the cylindrical portion of the first valve orifice, said second valve plug includes a cylindrical portion sized to snugly fit within the cylindrical portion of the second valve orifice, said third valve plug includes a cylindrical portion sized to snugly fit within the cylindrical portion of the fourth valve orifice, and said fourth valve plug includes a cylindrical portion sized to snugly fit within the cylindrical portion of the third valve orifice, wherein during movement of the first poppet between a first position wherein the closure surface of the first valve plug is seated against the first valve seat and a second position in which the closure surface of the second valve plug is seated against the second valve seat, the cylindrical portion of at least one of said first and second valve plugs is in a flow controlling relationship with the cylindrical portion of its valve orifice, to prevent a short circuiting of pressure from the pressure cavity to the first return passageway, and wherein during movement of the second poppet between a first position wherein the closure surface of the third valve plug is seated against the fourth valve seat and a second position in which the closure surface of the fourth valve plug is seated against the third valve seat, the cylindrical portion of at least one of said third and fourth valve plugs is in a flow controlling relationship with the cylindrical portion of its valve orifice, to prevent a short circuiting of pressure from the pressure cavity to the second return passageway.

3. A valve according to claim 2, wherein each valve seat is a circular corner edge.

4. A valve according to claim 3, wherein each valve seat is radially offset from the cylindrical portion of the associated valve region.

5. A switching valve, comprising:

a first end cavity having a first end wall;

a first cylindrical cavity;

a first divider wall between said first end cavity and said first cylinder cavity, said first divider wall including a first valve orifice;

a pressure cavity;

a second divider wall between said first cylinder cavity and said pressure cavity, said second divider wall including a second valve orifice;

a second cylinder cavity including a sidewall;

a third divider wall between said pressure cavity and said second cylinder cavity, said third divider wall including a third valve orifice;

a second end cavity;

a fourth divider wall between said second cylinder cavity and said second end cavity, said fourth divider wall including a fourth valve orifice;

said first divider wall including a first valve seat directed towards said first end cavity;

said second divider wall including a second valve seat directed towards said pressure cavity;

said third divider wall including a third valve seat directed towards said second end cavity;

said fourth divider wall including a fourth valve seat directed towards said second end cavity;

a first poppet including a first piston and a first valve plug in said first end cavity, a second valve plug in said pressure cavity, a first connector portion interconnecting said first piston and said first valve plug, and a second connector portion interconnecting said first valve plug and said second valve plug, said first piston including an end surface directed towards said first end wall, said first valve plug including a closure surface directed towards the first valve seat, said second valve plug including a closure surface directed towards said second valve seat, said second valve plug including an end surface directed towards said pressure cavity, said end surface on said first piston being larger in area than said end surface on said second valve plug;

a second poppet including a second piston and a third valve plug in said second end cavity, a fourth valve plug in said pressure cavity, a third connector portion interconnecting said second piston and said third valve plug, and a fourth connector portion interconnecting said third valve plug and said fourth valve plug, said second piston including an end surface directed towards said second end wall, said third valve plug including a closure surface directed towards the fourth valve seat, said fourth valve plug including a closure surface directed towards the third valve seat, and said fourth valve plug including an end surface directed towards said pressure cavity, said end surface on said second piston being larger in area than said end surface on said fourth valve plug;

a pressure delivery passageway communicating with said pressure cavity;

a first return passageway communicating with said first end cavity, adjacent said first divider wall;

a second return passageway communicating with said second end cavity, adjacent said fourth divider wall;

a first cylinder passageway communicating with said first cylinder cavity;

a second cylinder passageway communicating with said second cylinder cavity;

a first pilot passageway communicating with the first end cavity, between the first end wall and the end surface of the first piston;

a second pilot passageway communicating with the second end cavity, between the second end surface and the end surface of the second piston; and control means having a first position in which the first pilot passageway is connected to pressure and the second pilot passageway is connected to return, and a second position in which the second pilot passageway is connected to pressure and the first pilot passageway is connected to return, wherein when the control means is in said first position, the first valve plug is seated on the first valve seat, closing the first valve orifice, the second valve plug is spaced from the first valve seat, opening the second valve orifice and connecting the pressure cavity to the first cylinder passageway, the fourth valve plug is seated on the third valve seat, closing the third valve orifice, and the third valve plug is spaced from the fourth valve seat, opening the fourth valve orifice and connecting the second cylinder passageway with return, wherein when the control means is in said second position, the second valve plug is seated on the second valve seat, closing the second valve orifice, the first valve plug is spaced from the first valve seat, opening the first valve orifice and connecting the first cylinder passageway with return, the third valve plug is seated against the fourth valve seat, closing the fourth orifice, and the fourth valve plug is spaced from the third valve seat, opening the third valve orifice, connecting the pressure cavity to the second cylinder passageway; wherein the control means comprises a control rod that is movable endwise between two positions, said control rod including a first control passageway positioned when the control rod is in its first position to connect the first pilot passageway to pressure, and when the control rod is in its second position, to connect the first pilot passageway to return, said control rod including a second control passageway positioned when the control rod is in its first position to connect the second pilot passageway to return, and when the control rod is in its second position, to connect the second pilot passageway to pressure.

6. A switching valve according to claim 5, wherein the cavities and said first and second poppets are coaxial, the first and second poppets include coaxial center passageways, and said control rod includes a central portion located within said center passageway.

7. A switching valve according to claim 6, wherein the second valve plug is detachably secured to the second connector portion of the first poppet and the fourth valve plug is detachably secured to the fourth connector portion of the second poppet, wherein the first poppet minus the second valve plug is inserted into the valve by way of the first end cavity, and the second poppet minus the fourth valve plug is inserted into the valve by way of the second end cavity, wherein said pressure cavity includes a side opening through which the second valve plug is insertable, for connection with the second connector portion within the pressure cavity, and through which the fourth valve plug is insertable, for connection with the fourth connector portion within the pressure cavity, and wherein said valve includes a closure plug for said side opening.

8. A valve according to claim 5, wherein each valve seat is a circular corner edge.

9. A valve according to claim 8, wherein each valve orifice includes a generally cylindrical sidewall and each valve seat is radially offset from the sidewall of the associated valve orifice.

* * * * *

UNITED STATES PATENT AND TRADEMARK OFFICE

CERTIFICATE OF CORRECTION

PATENT NO. : 5,103,866

DATED : April 14, 1992

INVENTOR(S) : R. Keith Foster

It is certified that error appears in the above-indentified patent and that said Letters Patent is hereby corrected as shown below:

Col. 3, lines 40 and 41, delete "and the second end cavity".

Col. 4, line 6, "fourth" should be -- third --.

Col. 4, line 37, "third" should be -- fourth -- and "fourth" should be -- third --.

Col. 4, line 38, there is a period after "orifice".

Col. 6, line 13, "contact With" should be -- contact with --.

Col. 6, line 59, there is a comma after "Cavity 14".

Col. 6, line 63, "communication With" should be -- communication with --.

Col. 7, line 14, there is a comma after "return".

Col. 9, line 44, "chamber 106′." should be -- chamber 106′, --.

Col. 9, line 55, "22′ and 24," should be -- 22′ and 24′ --.

Col. 10, line 61, "constructed valve" should be "constructed Valve --.

Col. 10, line 64, "valve 10" should be -- valve 110 --.

Col. 11, line 6, "cavity 12," should be -- cavity 12′ --.

Col. 11, line 7, "rod 90," should be -- rod 90′ --.

Col. 11, line 33, "drilled end of" should be --drilled through--.

UNITED STATES PATENT AND TRADEMARK OFFICE

CERTIFICATE OF CORRECTION

PATENT NO. : 5,103,866

DATED : April 14, 1992

INVENTOR(S) : R. Keith Foster

It is certified that error appears in the above-indentified patent and that said Letters Patent is hereby corrected as shown below:

Col. 13, line 8, "chamber 56," should be -- chamber 56′ --.

Col. 13, lines 46 and 47, "member 30," should be -- member 30′ --.

Col. 14, line 12, "previcusly" should be -- previously --.

Col. 14, lines 29 and 30, "oontact", both occurrences, should be -- contact --.

Claim 5, col. 18, line 39, "cylindrical" should be -- cylinder --.

Claim 5, col. 18, line 60, "said second end cavity" should be -- the pressure cavity --.

Claim 5, col. 19, line 52, "first" should be -- second --.

Signed and Sealed this

Twenty-sixth Day of October, 1993

*Attest:*

*Attesting Officer*

Bruce Lehman

BRUCE LEHMAN

*Commissioner of Patents and Trademarks*